United States Patent [19]

Tanaka et al.

[11] 4,152,918

[45] May 8, 1979

[54] VERTICAL ROLLING MILL

[75] Inventors: Teruaki Tanaka, Aichi; Takayuki Haruna, Tokai, both of Japan

[73] Assignee: Daido Tokushuko Kabushiki Kaisha, Nagoya, Japan

[21] Appl. No.: 845,974

[22] Filed: Oct. 27, 1977

[30] Foreign Application Priority Data

Nov. 1, 1976 [JP] Japan ..... 51-146920[U]

[51] Int. Cl.[2] ..... G21B 31/08

[52] U.S. Cl. ..... 72/238

[58] Field of Search ..... 72/238, 239

[56] References Cited

U.S. PATENT DOCUMENTS

| | | | |
|---|---|---|---|
| 1,891,579 | 12/1932 | Schreck | 72/239 X |
| 2,603,990 | 7/1952 | Sheperdson et al. | 72/238 |
| 3,194,045 | 7/1965 | Hill | 72/238 |
| 3,383,897 | 5/1968 | O'Brien | 72/238 |

*Primary Examiner*—Milton S. Mehr

*Attorney, Agent, or Firm*—Blanchard, Flynn, Thiel, Boutell & Tanis

[57] ABSTRACT

A vertical rolling mill according to the present invention comprises at least a pair of rolling rolls having vertical axes of rotation, a stand which supports said rolling rolls in rotatable fashion, a frame which is provided with a sole plate whereon said stand is mounted and an upright portion extending upwardly at one side of said sole plate, at least a pair of spindle members having vertical axes of rotation respectively which are juxtaposed below said sole plate of the frame and are connected with a driving member so as to rotate in opposite directions, and holding members which are installed on said upright portion of the frame, said stand being devised so that, when it is mounted on the sole plate, the side thereof is held by said holding members, and each rolling roll is connected with each spindle member below said stand so as to be driven thereby, and said pair of rolling rolls are provided with a single caliber formed thereon for the purpose of inserting the material-to-be-rolled therein.

3 Claims, 5 Drawing Figures

VERTICAL ROLLING MILL

BACKGROUND OF THE INVENTION

The present invention relates to a vertical rolling mill which is provided with at least a pair of rolling rolls having vertical axes of rotation.

To explain the conventional rolling mills of this type reference is made to a rolling mill 31 shown in FIG. 1 as an example. A pair of spindle members 33 and 33' are connected to a driving member 32 and said spindle members are disposed directly above a stand 35 provided with a pair of rolling rolls 34 and 34'. The spindle members 33 and 33' are respectively connected with the rolling rolls 34 and 34' so as to drive them from above. Therefore, in the case of this rolling mill 31, at the time of replacing the stand 35, it is impossible to perform said replacing by lifting same with a machine, such as crane, etc., unless the stand 35 is shifted from the prescribed position for rolling indicated by the solid line to one side as indicated by the dotted line because the spindle members 33 and 33' obstruct it. Accordingly, provision of a mechanism 36 for the purpose of thus shifting the stand 35 sideways is indispensable. Besides, since much time is required in the work of replacing the stand 35, as stated above, in order to reduce the frequency of replacing, multicaliber-type rolls 34 and 34' provided with plural number of calibers for inserting the material-to-be-rolled have been adopted. Because of the adoption of this multicaliber-type roll, provision of a mechanism 37 for effecting vertical movement of the stand 35 in order to align all the calibers with the pass line appropriately is indispensable. Inasmuch as the rolling mill 31 is provided with the mechanisms 36 and 37 as stated above, it becomes large in size, complicated in structure and heavy in weight as a whole, necessitating a large-size foundation at the time of erecting it, and also a spacious site is required therefore. Accordingly, it is difficult to erect this rolling mill 31 among existing various machines for the rolling process in factories. Moreover, inasmuch as the stand 35 per se having said multicaliber-type rolls 34 and 34' is heavy in weight, the machine for use in lifting it, e.g., crane, etc., must be of a large size. The upper end of a lifting machine such as a large-sized crane and the like at the time of operation is close to the restricted height of factory buildings, and therefore it must be operated with prudence. Consequently, the work of replacing the stand 35 is inconvenient and is difficult to perform.

As set forth above, the conventional rolling mills exemplified by the rolling mill 31 illustrated in FIG. 1 have been accompanied by various drawbacks such as enumerated in the foregoing.

SUMMARY OF THE INVENTION

The primary object of the present invention is to provide a vertical rolling mill which will eliminate the aforedescribed drawbacks of the conventional vertical rolling mills.

Another object of the present invention is to provide a vertical rolling mill wherein at least a pair of spindle members, for the purpose of rotating at least a pair of rolling rolls having vertical axes of rotation, are juxtaposed below a sole plate installed on a frame on which is mounted a stand for supporting said rolling rolls in rotatable fashion. When said stand is mounted on said sole plate the rolling rolls are connected with the spindle members respectively so as to be driven thereby, whereby there is no necessity for shifting the stand sideways from the prescribed position for rolling beforehand at the time of lifting the stand in order to replace it with another stand. The replacing work can be performed by lifting the stand directly from the rolling position, and accordingly, provision of any particular mechanism for moving the stand can be dispensed with and the rolling mill can be of a small size and light weight compared with the conventional rolling mills, thereby facilitating the stand replacing work. The pair of rolling rolls are provided with a single caliber formed thereon whereby it is not necessary to provide any specific mechanism for effecting vertical movement of the stand necessary for aligning all the calibers with the pass line appropriately. Therefore, the rolling mill can be of small size and light weight compared with the conventional rolling mills employing a pair of multicaliber-type rolls and the foundation work at the time of erecting the rolling mill can be simplified.

A further object of the present invention is to provide a vertical rolling mill wherein an upright portion is provided on the sole plate and extends upwardly at one side thereof. A guide face parallel to the direction of inserting the material-to-be-rolled between said pair of rolling rolls is formed on said upright portion. Another guide face which cooperates with this guide face is formed on the stand. The stand is further provided with an adjusting member for advancing or retracting said guide face. By the action of this adjusting member the horizontal position of the caliber can be adjusted at will.

A still further object of the present invention is to provide a vertical rolling mill which comprises universal couplings as said spindle members, each of said couplings being of a self-standing and short length type and having its upper part provided with an engaging portion for the purpose of connecting the coupling with the lower end of the rolling roll so as to drive said roll. The interspace of the paired rolling rolls is not restricted at the time of installing them on the stand in rotatable fashion. Accordingly, a delicate, subtle adjustment of the caliber can be performed by slightly widening or narrowing said interspace. Because said coupling is of a self-standing and short length type, no coupling holder is required therefor and, moreover, the distance from the sole plate to the bottom of the reduction means can be shortened.

An additional object of the present invention is to provide a vertical rolling mill wherein holding members are installed on the upright portion of the frame by disposing same on one side of the sole plate so as to hold the sole plate therebetween. Each of the holding members is provided with a projection so as to clamp said stand at the time of operation. The stand is provided with vertical grooves which cooperate with these projections, whereby when mounting the stand on the sole plate, the stand can be very easily fixed on a prescribed position on said table.

DETAILED DESCRIPTION OF THE INVENTION

Figure 1:
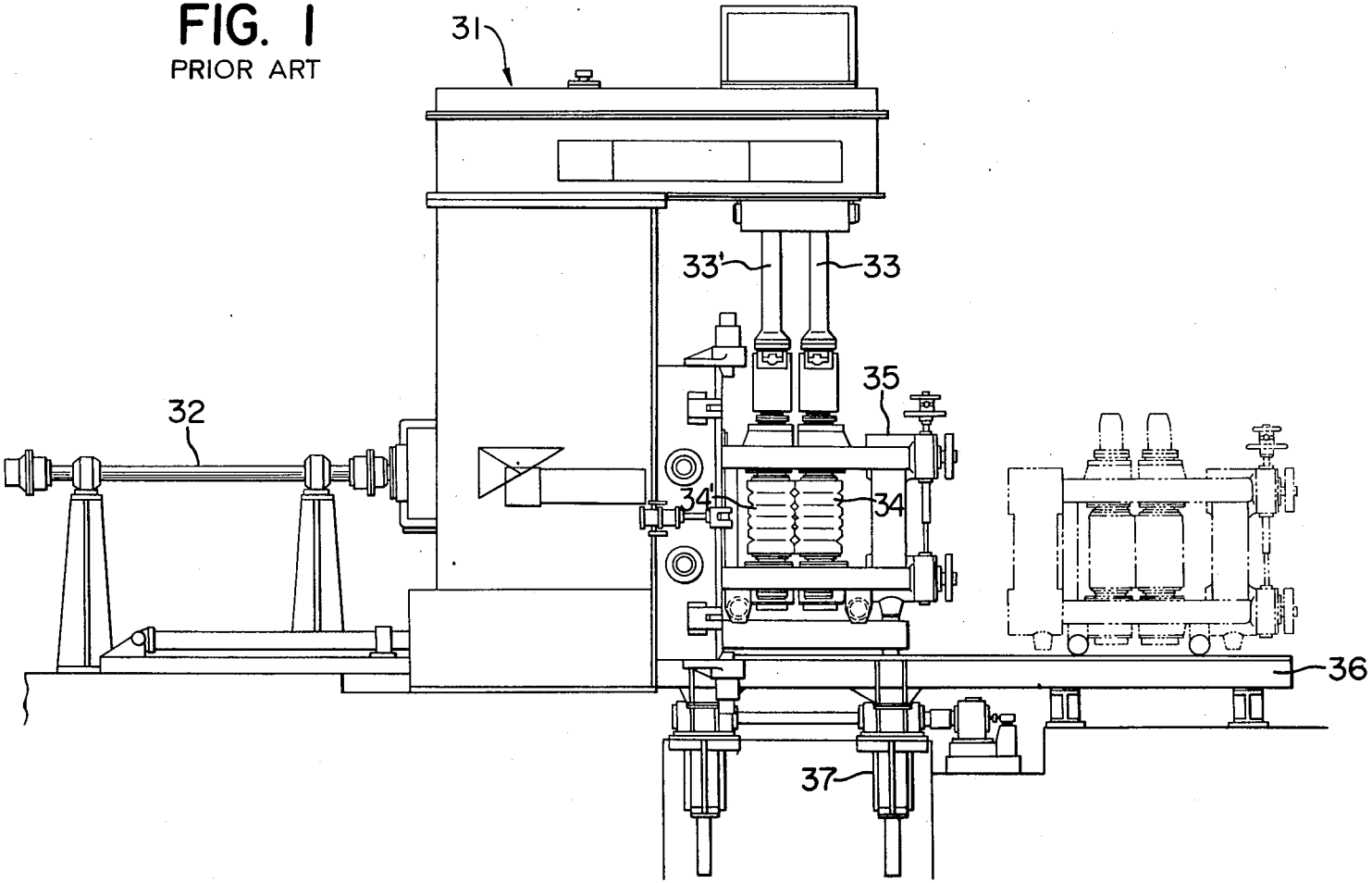
FIG. 1 PRIOR ART
FIG. 1 is a diagrammatic, front elevational view, partly broken away, illustrating a typical example of the conventional vertical rolling rolls.
Figure 2:
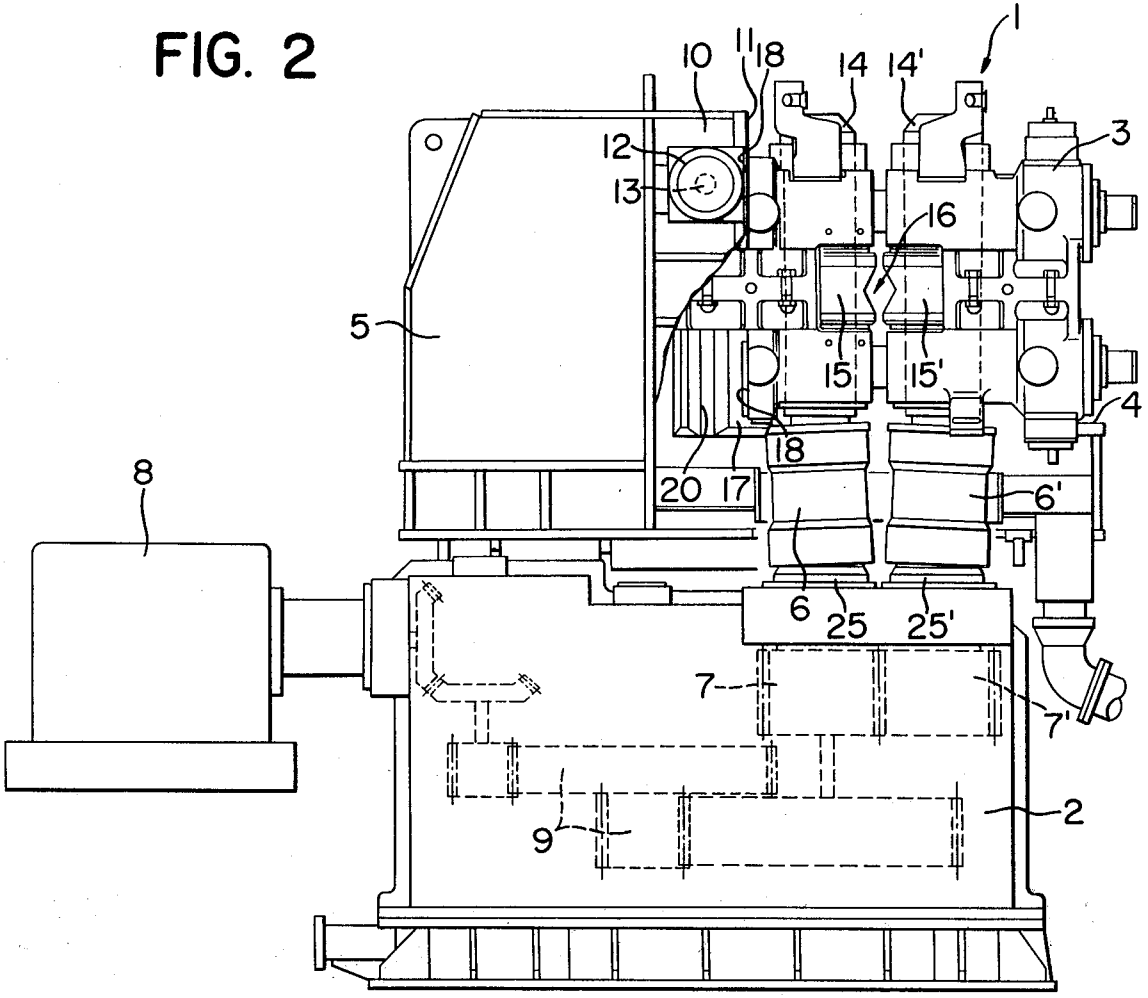
FIG. 2 is a diagrammatic, front elevational view, partly broken away, illustrating one embodiment of the vertical rolling mill according to the present invention.
Figure 3:
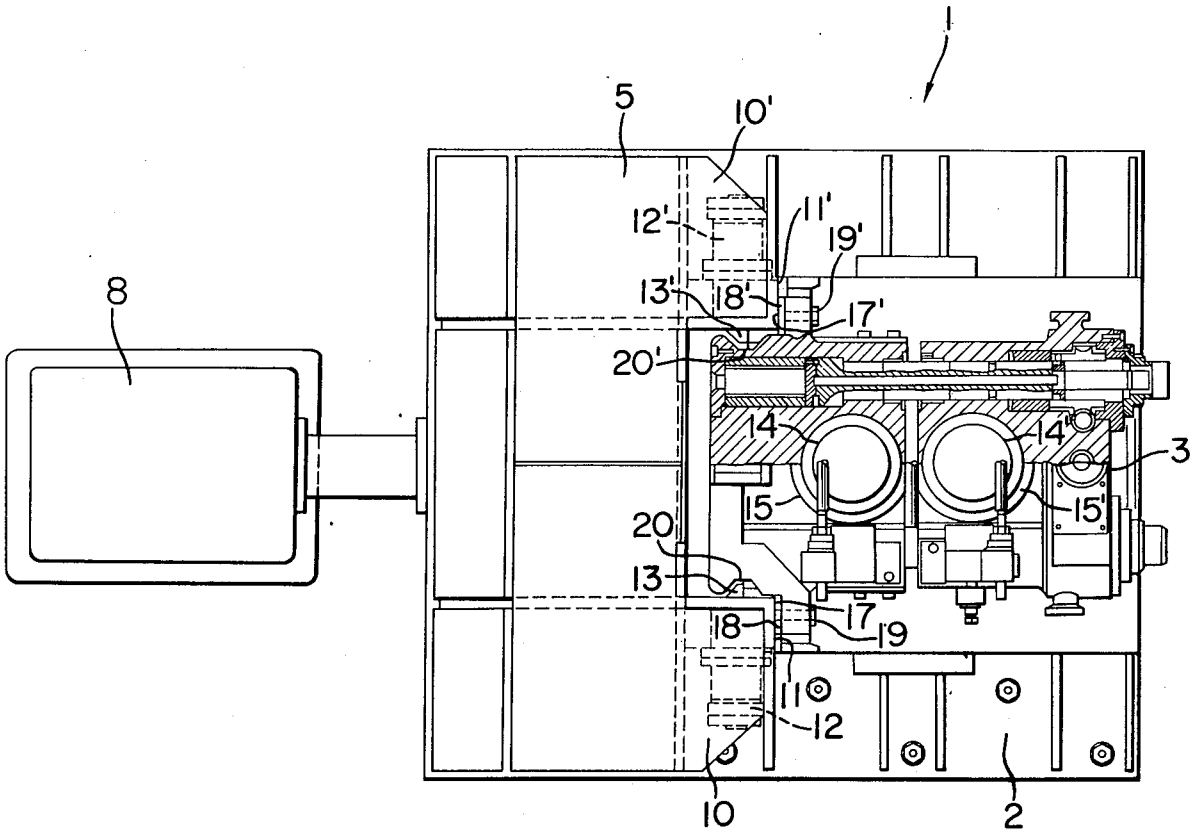
FIG. 3 is a diagrammatic plan view, partly broken away, of the same embodiment as illustrated in FIG. 2.

Shown in FIGS. 2 and 3 is one embodiment of the present invention. This vertical rolling mill 1 shown therein is, as is obvious from the drawings, composed of a frame 2 and a stand 3.

Figure 5:
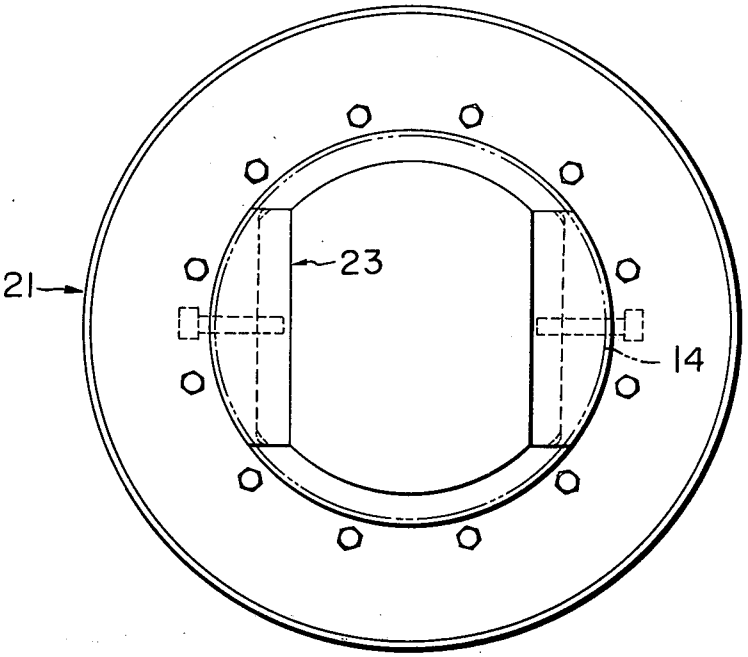
FIG. 5 is a plan view illustrating the same embodiment as shown in FIG. 4.
Figure 4:
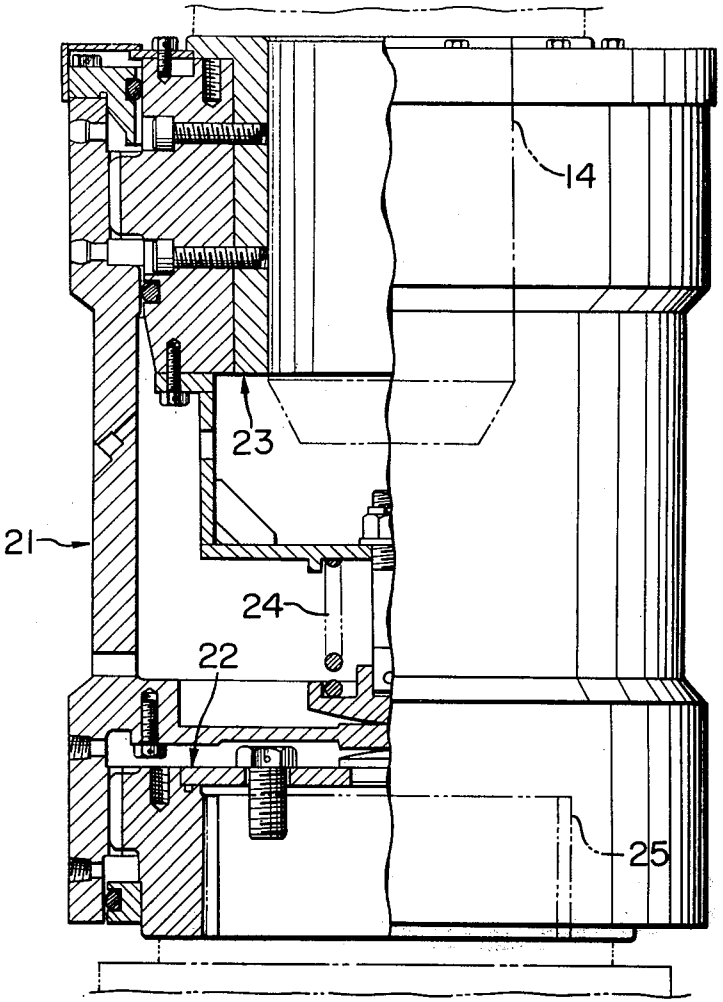
FIG. 4 is a partially cutaway elevational view illustrating one embodiment of the universal coupling for use in the vertical rolling mill according to the present invention.

The frame 2 is provided with a sole plate 4 disposed horizontally in order to mount the stand 3 thereon and an upright portion 5 extends upwardly at one side of said sole plate 4. Below the sole plate 4 are juxtaposed a pair of spindles 6 and 6' having vertical axes of rotation, and these spindles 6 and 6' consist of universal couplings. These universal couplings 6 and 6' are constructed in the same manner and of a self-standing and short length type respectively. They are each comprised of an outer cylinder 21, a cylindrical lower portion 22 accommodated within the lower part of said outer cylinder 21 and a cylindrical upper portion 23 accommodated within the upper part of the outer cylinder 21 as shown in FIGS. 4 and 5. In the lower portion 22 there is provided an opening the inner circumference of which is splined. On the other hand the upper portion 23 has an opening the cross-sectional configuration of which is non-circular as shown in FIG. 5. In the inside of the tubular cylinder 21 connecting the lower portion 22 and the upper portion 23 in axially displaceable fashion, there is provided a spring 24 which shortens the length of the coupling by narrowing the distance between the upper and lower parts thereof along the axial direction whenever the coupling is subjected to external force working along practically an axial direction.

The universal couplings 6 and 6' have their lower portions 22 fixed on a pair of splines 25 and 25' extending upwardly perpendicularly from an intermeshed pair of gears 7 and 7' along the axis of rotation thereof respectively. These gears 7 and 7' constitute a member of the gear drive mechanism 9 connected to a motor 8. Accordingly, the couplings 6 and 6' are devised to rotate in opposite directionsin response to operation of the motor 8. The upper portions 23 of the couplings 6 and 6', when the couplings are fixed on the splines, 25 and 25' extend through an opening formed in the sole plate 4, and the upper extremities thereof are so disposed as to project slightly above the level of the surface of the sole plate 4 when the stand 3 is not mounted on the sole plate 4.

On the upright portion 5 of the frame 2 there is provided a pair of overhung portions 10 and 10' for holding one side of the sole plate 4 therebetween. These overhung portions 10 and 10' are provided with perpendicular guide faces 11 and 11' respectively extending parallel to the direction of inserting the material-to-be-rolled between the rolling rolls. A pair of holding members 12 and 12' forming a pair of confronting are provided both on the upper part and the lower part of the overhung portions 10 and 10'. The holding members 12 and 12' face each other. The inwardly confronting fore ends of these holding members 12 and 12' are equipped with projections 13 and 13' respectively. These projections 13 and 13' are retracted in the holding members 12 and 12' respectively at the time when the holding members are not in operation, while at the time when the holding members are operated by a fluid they project from the holding members 12 and 12' respectively and toward each other between the confronting wall surfaces of the overhung portions 10 and 10'.

On the stand 3 are rotatably installed the rotary shafts 14 and 14' which extend vertically and are located adjacent each other leaving a space therebetween. On the intermediate portions of these rotary shafts 14 and 14' there is installed a pair of rolling rolls 15 and 15' respectively at identical elevations. The lower ends of the rotary shafts 14 and 14' are configured such that when the stand 3 is mounted on the sole plate 4, they face the afore described opening of the sole plate 4 and fit closely in the non-circular openings formed in the upper portion 23 of the universal couplings 6 and 6' and are disposed therein, whereby the shafts 14 and 14' are interconnected so as to rotate in opposite directions with the rotation of the couplings 6 and 6'. The pair of rolling rolls 15 and 15' are made short in dimension just long enough to form a single caliber thereon, and they define a single caliber 16.

On one side of the stand 3 is provided a pair of shoulders 17 and 17' at both the upper part and the lower part. The shoulders are so configured as to fit on the corners of the overhung portions 10 and 10' of the upright portion 5 of the frame 2. On these shoulders 17 and 17' are formed perpendicular guide faces 18 and 18' which are useful at the time of mounting the stand 3 on the sole plate 4 in cooperation with the guide faces 11 and 11' formed on the overhung portions 10 and 10'. The adjusting screws 19 and 19' are provided on the stand 3 for the purpose of advancing and retracting the guide faces 18 and 18' and thereby adjusting the horizontal position of the caliber 16 at the time when the stand 3 has been mounted on the sole plate 4. The shoulders 17 and 17' are further provided with perpendicularly extending grooves 20 and 20', respectively, for the purpose of accommodating the projections 13 and 13' adopted to project from the fore ends of the holding members 12 and 12' between the confronting wall surfaces of the overhung portions 10 and 10' at the time when the stand 3 has been mounted on the sole plate 4 and thereby fixing the stand 3.

Next, in the following will be explained the mode of the operation of the foregoing embodiment.

On the occasion of placing the stand 3 on the frame 2, the stand 3 is lifted by a machine such as crane and the like and is let down from above the sole plate 4 while making the guide faces 18 and 18' run along the guide faces 11 and 11'. By closely fitting the lower ends of the rotary shafts 14 and 14' in the openings provided in the upper portions 23 of the universal couplings 6 and 6', the stand 3 is made to stand still on the sole plate 4, and further the projections 13 and 13' are fitted in the perpendicular grooves 20 and 20' by actuating the holding members 12 and 12'. By so doing, the central position of the caliber 16 is defined by the vertical elevation above the sole plate 4 and the horizontal distance from the guide faces 11 and 11' and it is set to coincide with a prescribed pass line. When the motor 8 is driven under such conditions, the universal couplings 6 and 6' rotate in opposite directions through the gear drive mechanism 9. The rotary shafts 14 and 14' interlocked with couplings 6 and 6' rotate in concert with the couplings, whereby the rolling rolls 15 and 15' rotate in opposite directions to perform the rolling of the rod-shaped material-to-be-rolled inserted in the caliber 16. Adjustment of the horizontal position of the caliber 16 is performed by advancing or retracting the guide faces 18 and 18' through the operation of the adjusting screws 19 and 19' and thereby adjusting the distance between the caliber 16 and the guide faces 11 and 11'.

On the occasion of dismounting the stand 3 from the frame 2 in order to replace it, the motor 8 is stopped, the projections 13 and 13' are disengaged from the perpendicular grooves 20 and 20' by actuating the holding members 12 and 12' in a direction opposite to the foregoing, the stand 3 is thereafter moved to another place by lifting with a machine such as crane, etc., and successively a new stand 3' is positioned on the frame 2 in the same way as described above.

Inasmuch as a vertical rolling mill according to the present invention is of such a construction as described above, at the time of replacing the stand thereof, said stand can be directly lifted by a crane or the like from the prescribed position for rolling. Consequently, it does not require any conventional mechanism for the purpose of moving the stand sideways as well as up and down and the stand can be of a small size and light weight. Accordingly, it can be placed on a site of limited area with a relatively simple, ordinary foundation. A vertical rolling mill according to the present invention is also advantageous in that the rolling rolls employed therein, which are of the single-caliber type, are made shorter and lighter than rolls of the multi-caliber type. Therefore, a vertical rolling mill according to the present invention is advantageous compared with the conventional rolling mills in that the stand per se is of light weight, a machine such as crane, etc. for use in lifting the stand suffices to be of a relatively small size. As a result, the size and weight of the rolling mill as a whole can be further reduced, thereby facilitating the operation of machine such as crane, etc., and further simplifying such works as the settling of rolling mill, the replacing of stand, and so forth.

Although a particular preferred embodiment of the invention has been disclosed in detail for illustrative purpose, it will be recognized that variations or modifications of the above disclosed apparatus, including the arrangement of parts, lie within the scope of the present invention.

What is claimed is:

1. A vertical rolling mill, comprising: a frame having a substantially horizontal sole plate and an upright frame portion extending upwardly from said sole plate adjacent to one lateral end of said sole plate, the zone above said sole plate and located between said frame portion and the opposite lateral end of the sole plate being open at its top and being adapted to receive a roll stand, said upright frame portion having front and rear sections which extend partway toward the opposite lateral end of said sole plate, said sections having opposed upright walls which define an open-top guide compartment between said sections and opening laterally into said zone, said sections each also having a vertical guide wall facing toward said opposite lateral end of said sole plate;

driving means mounted on said frame and comprising a pair of vertical driven spindles which are rotatable about vertical axes in opposite circumferential directions and which extend upwardly to the lower end of said zone;

a pair of holding members mounted in the opposed upright walls of said sections, said holding members having movable locking projections mounted thereon and adapted to be moved between an advanced position in which they project into said compartment from opposite sides thereof and a retracted position in which they are retracted from said compartment;

a roll stand positioned in said zone, said roll stand having a pair of rolls mounted thereon for rotation about vertical axes of rotation, said rolls being mounted in parallel circumferentially adjacent relation, each roll having a single circumferential groove in the periphery thereof with said circumferential grooves being positioned in vertical alignment with each other to define a caliber through which the material to be rolled can be moved, said roll stand having front and rear vertical guide surfaces for respectively vertically slidably engaging the vertical guide walls of said front and rear sections, said vertical guide surfaces of said roll stand extending parallel to the direction of movement of the material to be rolled through said caliber, said roll stand including a portion located between said front and rear guide surfaces which portion projects laterally into said compartment between said opposed upright walls of said front and rear sections, said roll stand portion having vertical grooves aligned with said movable locking projections and receiving said movable locking projections in the advanced positions thereof so that said locking projections prevent horizontal movement of said roll stand relative to said upright portions of said frame, means at the lower ends of said rolls and vertically slidable with respect to said spindles for releasably drivingly connecting said rolls to said spindles, so that said roll stand can be removed from said frame by moving said locking projections into their retracted positions and then lifting said roll stand upwardly.

2. A vertical rolling mill according to claim 1 including means for adjusting said front and rear vertical guide surfaces of said roll stand laterally relative to said sole plate for adjusting the positions of said guide surfaces and thereby adjusting the lateral position of said roll stand on said sole plate, said locking projections each having an inclined face on the side thereof remote from said zone and said grooves having correspondingly inclined faces on the remote side thereof, said remote faces of said projections and grooves being inclined inwardly and toward said zone.

3. A vertical rolling mill according to claim 2 in which said spindles each comprise a self-supporting short length universal coupling whose upper part is provided with an engaging portion for driving connection with the lower end of one of said rolls.

* * * * *